US009241566B1

(12) United States Patent
Chen et al.

(10) Patent No.: US 9,241,566 B1
(45) Date of Patent: Jan. 26, 2016

(54) MODULAR SHELVING

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD., Taichung (TW)

( * ) Notice: Subject to any disclaimer, the term of this patent is extended or adjusted under 35 U.S.C. 154(b) by 0 days.

(21) Appl. No.: 14/735,333

(22) Filed: Jun. 10, 2015

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 57/38*** | (2006.01) |
| ***A47B 55/00*** | (2006.01) |
| ***A47B 57/10*** | (2006.01) |
| ***A47B 57/20*** | (2006.01) |
| ***A47B 57/40*** | (2006.01) |

(52) U.S. Cl.
CPC ..... *A47B 57/38* (2013.01); *A47B 47/0091* (2013.01); *A47B 55/00* (2013.01); *A47B 57/10* (2013.01); *A47B 57/20* (2013.01); *A47B 57/40* (2013.01)

(58) Field of Classification Search
CPC ..... A47B 57/38; A47B 57/40; A47B 57/20; A47B 57/10; A47B 57/50; A47B 57/402; A47B 57/487; A47B 55/00; A47B 47/0091; A47F 5/0018; A47F 5/10; A47F 5/101; A47F 5/08
USPC ..... 211/134, 190, 191, 192, 103
See application file for complete search history.

(56) References Cited

U.S. PATENT DOCUMENTS

| | | | | |
|---|---|---|---|---|
| 2,932,409 | A * | 4/1960 | Wineman, Jr. | A47B 57/50 211/187 |
| 3,392,848 | A * | 7/1968 | McConnell | A47B 57/50 211/192 |
| 3,700,020 | A * | 10/1972 | Wallace | F16B 21/09 411/512 |
| 6,241,109 | B1 * | 6/2001 | Kautz | A47B 57/50 211/192 |
| 8,424,694 | B2 * | 4/2013 | Eustace | A47B 57/50 211/192 |
| 8,672,150 | B2 * | 3/2014 | Chen | A47B 57/50 108/147.16 |
| 2001/0045404 | A1 * | 11/2001 | Pellegrino | F16B 7/0446 211/192 |
| 2004/0079719 | A1 * | 4/2004 | Weaver | A47B 57/50 211/192 |
| 2005/0103734 | A1 * | 5/2005 | Saltzberg | A47B 57/50 211/187 |

* cited by examiner

*Primary Examiner* — Brian Glessner
*Assistant Examiner* — Paola Agudelo

(57) ABSTRACT

An adjustable shelving assembly includes four corner members of L-shaped cross section, either half of each corner member comprising aperture members each including an upper, larger circle and a lower, smaller, vertical hole overlapping the larger circle thereof; at least one group of four interconnecting members each comprising upper and lower aperture elements and a through hole besides each of the upper and lower aperture elements for positioning the interconnecting member, each aperture element comprising an upper, smaller, vertical hole and a lower, larger circle overlapping the vertical hole thereof; retainers each for fastening the corner member and the interconnecting member; and lock pins each comprising a head including a cut, and a shaft having ridges. The lock pin is fastened in the larger circle of the aperture member and the through hole. The cut is fastened in the larger circle of the aperture member.

5 Claims, 10 Drawing Sheets

MODULAR SHELVING

BACKGROUND OF THE INVENTION

1. Field of the Invention

The invention relates to modular shelving and more particularly to an adjustable shelving assembly with improved characteristics.

2. Description of Related Art

Adjustable shelving systems are well known. Such systems have many advantages including enabling a maximum use of storage space. Such shelving is also adapted to accommodate and support varying products sizes, thus enabling great flexibility as product designs and storage requirement changes.

U.S. Pat. No. 8,672,150 entitled "modular shelving" is characterized in that the interconnecting members are fastened by lock pins. However, there is gap between the interconnecting members and this can vibrate the shelving in response to force exerted thereon. To the worse, components of the shelving may loosen or even fall if the vibration is great.

Notwithstanding the prior art, the invention is neither taught nor rendered obvious thereby.

SUMMARY OF THE INVENTION

It is therefore one object of the invention to provide an adjustable shelving assembly comprising four corner members of L-shaped cross section, each corner member comprising two halves, and either half of each corner member comprising a plurality of spaced aperture members formed lengthwise, each aperture member including an upper, larger circle and a lower, smaller, vertical hole overlapping the larger circle thereof; at least one group of four interconnecting members, each interconnecting member comprising upper and lower aperture elements and a through hole besides each of the upper and lower aperture elements for positioning the interconnecting member, each aperture element comprising an upper, smaller, vertical hole and a lower, larger circle overlapping the vertical hole thereof; a plurality of elongated retainers each comprising two enlargements at both ends respectively, an annular groove adjacent to one enlargement, and an annular shoulder between the groove and the other enlargement wherein the aperture element is upside down relative to the aperture member such that the aperture element and aperture member are inverted relative to each other, a diameter of either enlargement is smaller than either a diameter of the larger circle of the aperture member or a diameter of the larger circle of the aperture element, and the diameter of either enlargement is larger than either a diameter of the vertical hole of the aperture member or a diameter of the vertical hole of the aperture element; and a plurality of lock pins each comprising a head including a cut, and a shaft extending from the head wherein the shaft of the lock pin has a diameter about equal to a diameter of the through hole and a length greater than a length of the through hole; wherein the groove of the retainer is clamped by the vertical hole of the aperture member, the interconnecting member is engaged with the corner member, the shoulder of the retainer is clamped by the vertical hole of the aperture element, the corner member and the interconnecting member are retained by the retainer, a substantial portion of the lock pin is fastened in the larger circle of the aperture member and the through hole, and the cut is partially in the larger circle of the aperture member and fastened in the larger circle of the aperture member.

The above and other objects, features and advantages of the invention will become apparent from the following detailed description taken with the accompanying drawings.

DETAILED DESCRIPTION OF THE INVENTION

Referring to FIGS. 1 to 8, an adjustable shelving assembly in accordance with the invention comprises the following components as discussed in detail below.

Four corner members 10 and four interconnecting members 20 are provided. Each interconnecting member 20 fastens two adjacent corner members 10 together as detailed later.

Figure 1:
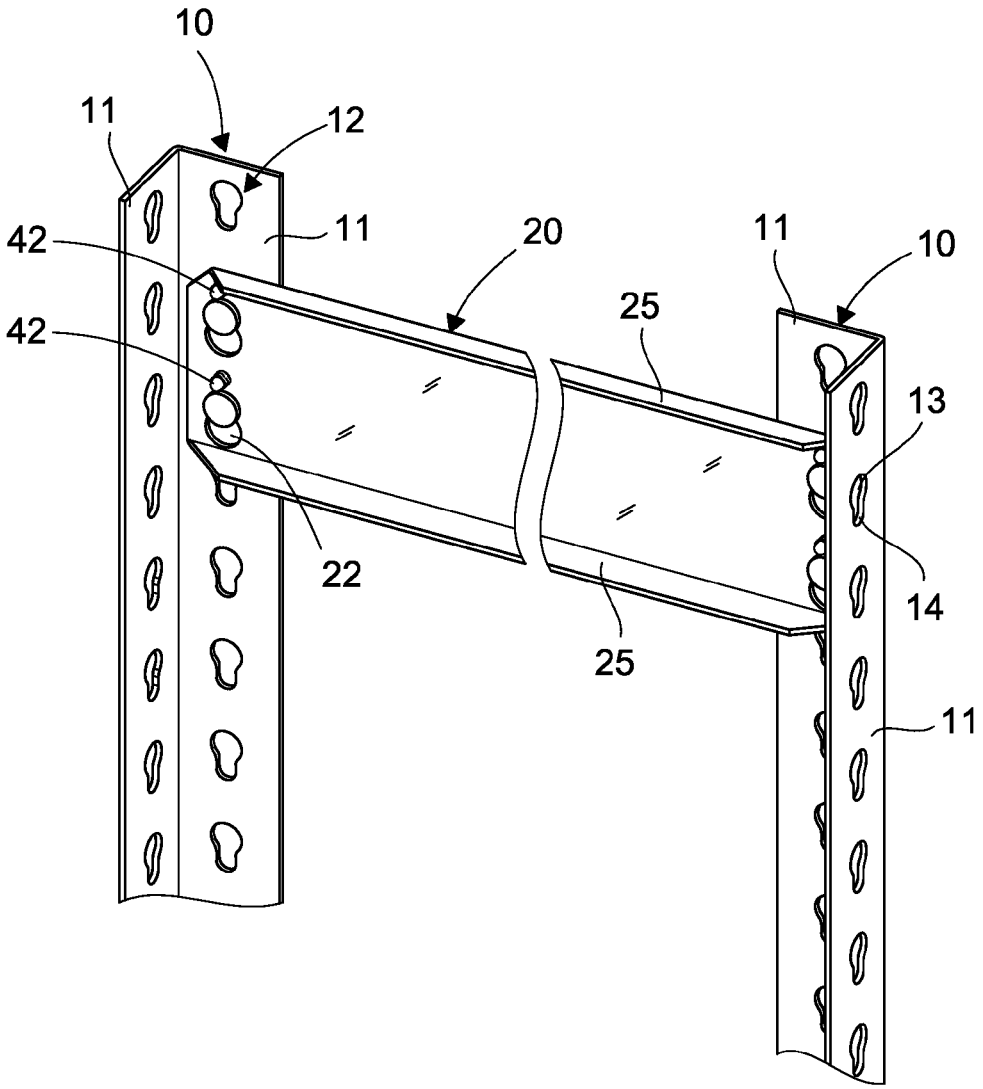
FIG. 1 is a perspective view of a portion of an adjustable shelving assembly according to the invention.
Figure 2:
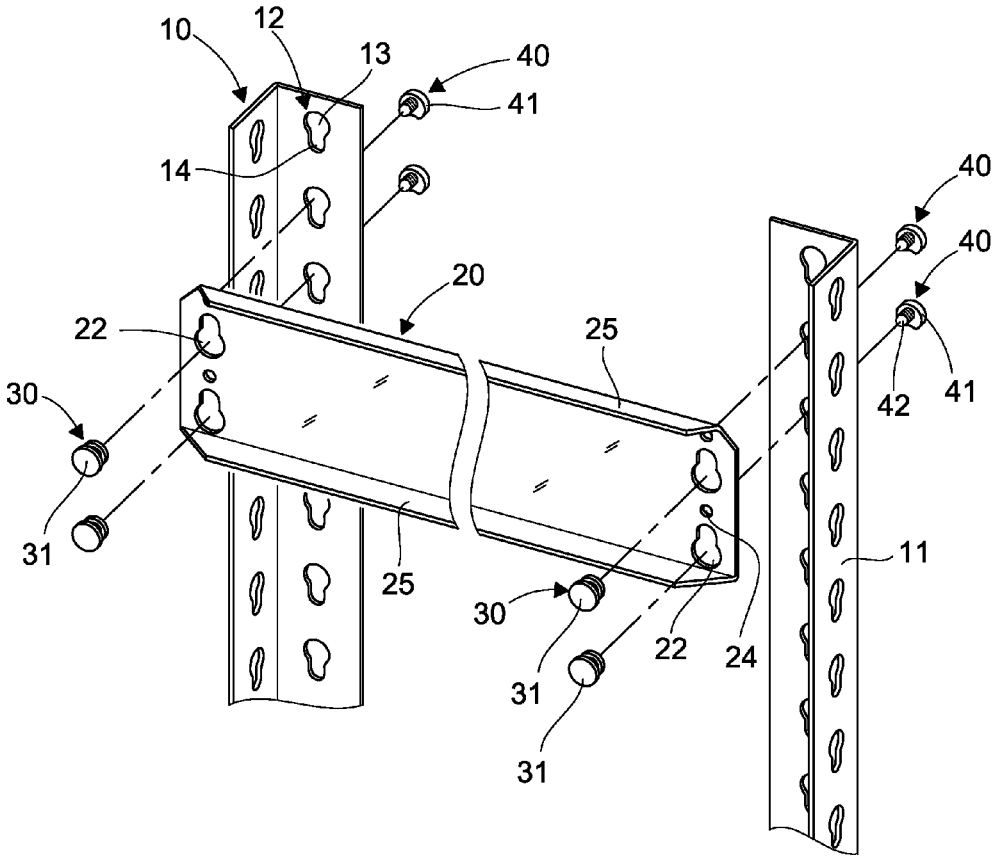
FIG. 2 is exploded view of FIG. 1 showing the detached interconnecting member.
Figure 2A:
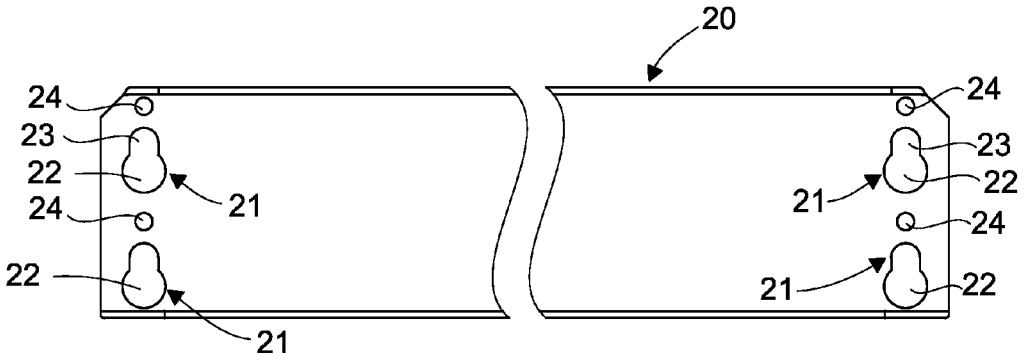
FIG. 2A is a plan view of the interconnecting member.
Figure 2B:
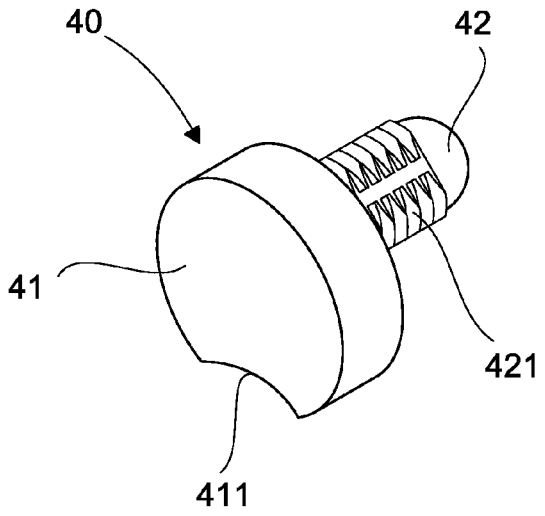
FIG. 2B is a perspective view of the lock pin.
Figure 2C:
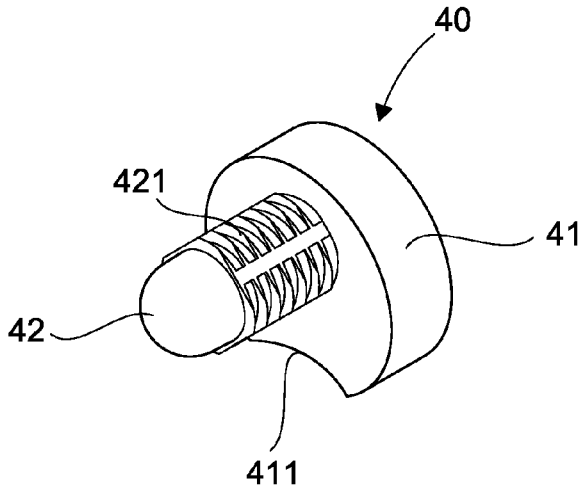
FIG. 2C is another perspective view of the lock pin viewing from the rear.

The corner member 10 is of L-shaped cross section and comprises two joined side walls 11 each including a plurality of equally spaced apertures 12 formed lengthwise. As shown in FIG. 2, the aperture 12 is shaped as an inverted teardrop and comprises an upper, larger circle 13 having a C-shaped periphery, and a lower, smaller, vertical hole 14 having a U-shaped periphery and overlapping the larger circle 13. The interconnecting member 20 is a groove having two 90-degree bent sides 25. On either of the interconnecting member 20, there are provided upper and lower apertures 21 and a through hole 24 besides each of the upper and lower apertures 21 for positioning the interconnecting member 20. As shown in FIG. 2, the aperture 21 is shaped as a teardrop and comprises an upper, smaller, vertical hole 23 having a U-shaped periphery, and a lower, larger circle 22 having a C-shaped periphery and overlapping the smaller, vertical hole 23. The aperture 21 is an inverted image of the aperture 12.

Figure 4:
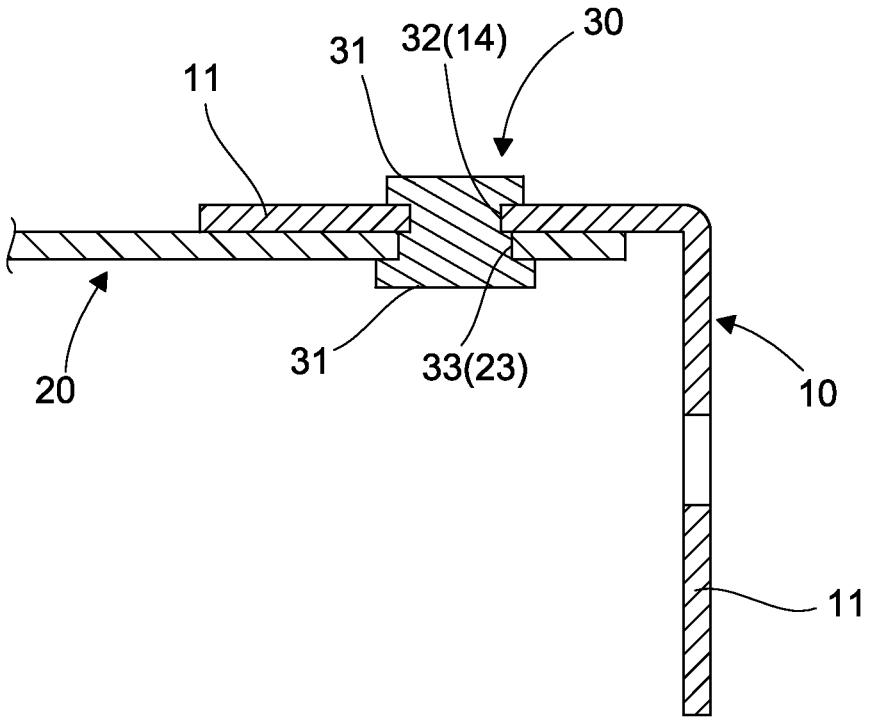
FIG. 4 is a cross-sectional view of one corner of the adjustable shelving assembly shown in FIG. 1.

As shown in FIG. 4, a retainer 30 is shaped as a barbell and comprises two enlargements 31 at both ends respectively, an annular groove 32 adjacent to one enlargement 31, and an annular shoulder 33 between the groove 32 and the other enlargement 31. Diameter of either enlargement 31 is smaller than that of the larger circle 22 or 13 but larger than a diameter of the vertical hole 23 or 14.

A lock pin 40, as the subject of the invention, comprises a circular head 41 including a cut 411, and a shaft 42 extending from a center of the head 41 and including a plurality of curved ridges 421 formed thereon. The head 41 has a diameter about the same as that of the larger circle 13. The shaft 42 has a diameter about the same as that of the through hole 24 and a length greater than that of the through hole 24.

Figure 3:
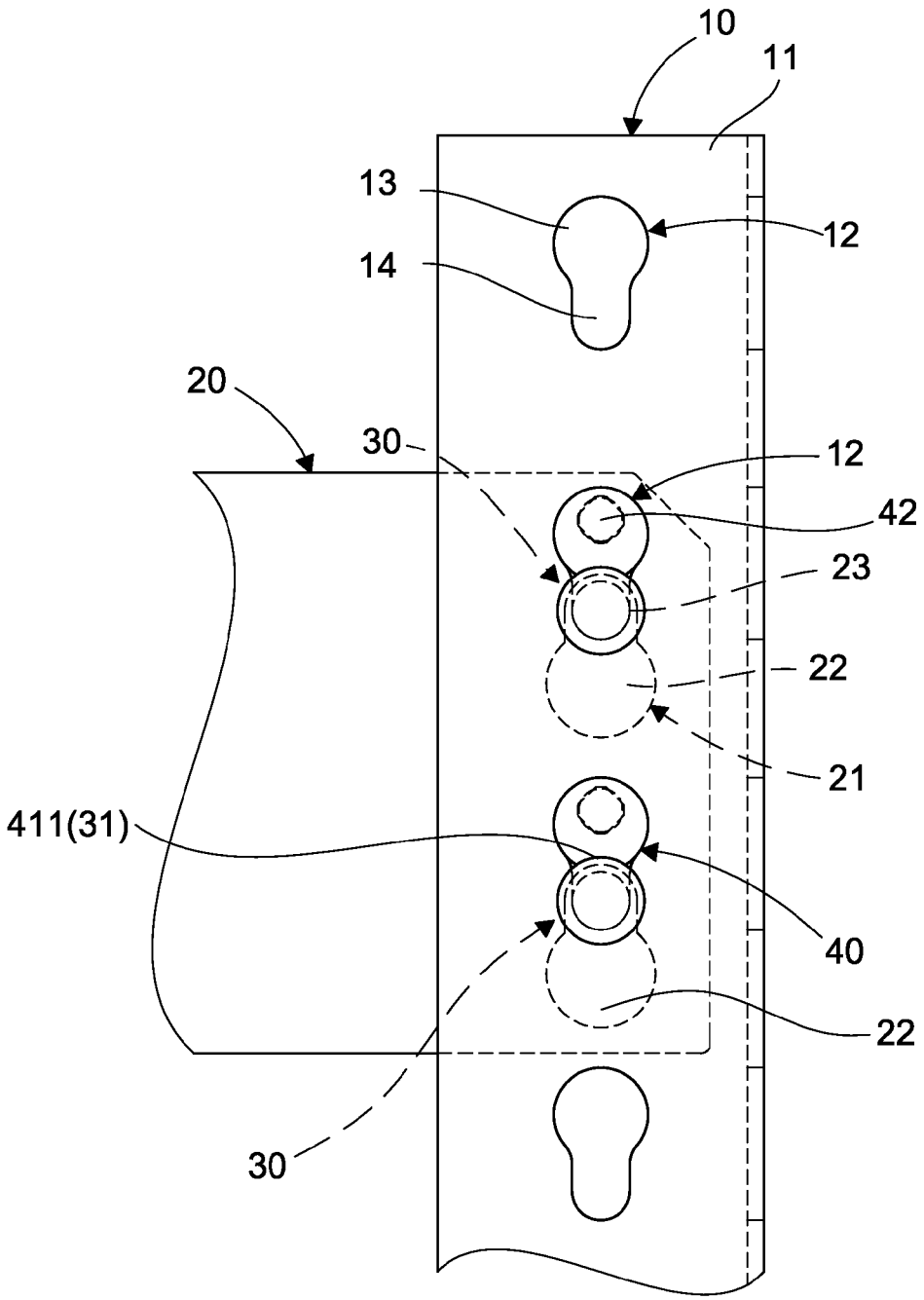
FIG. 3 is a plan view showing the interconnecting member and the corner member being fastened.
Figure 5:
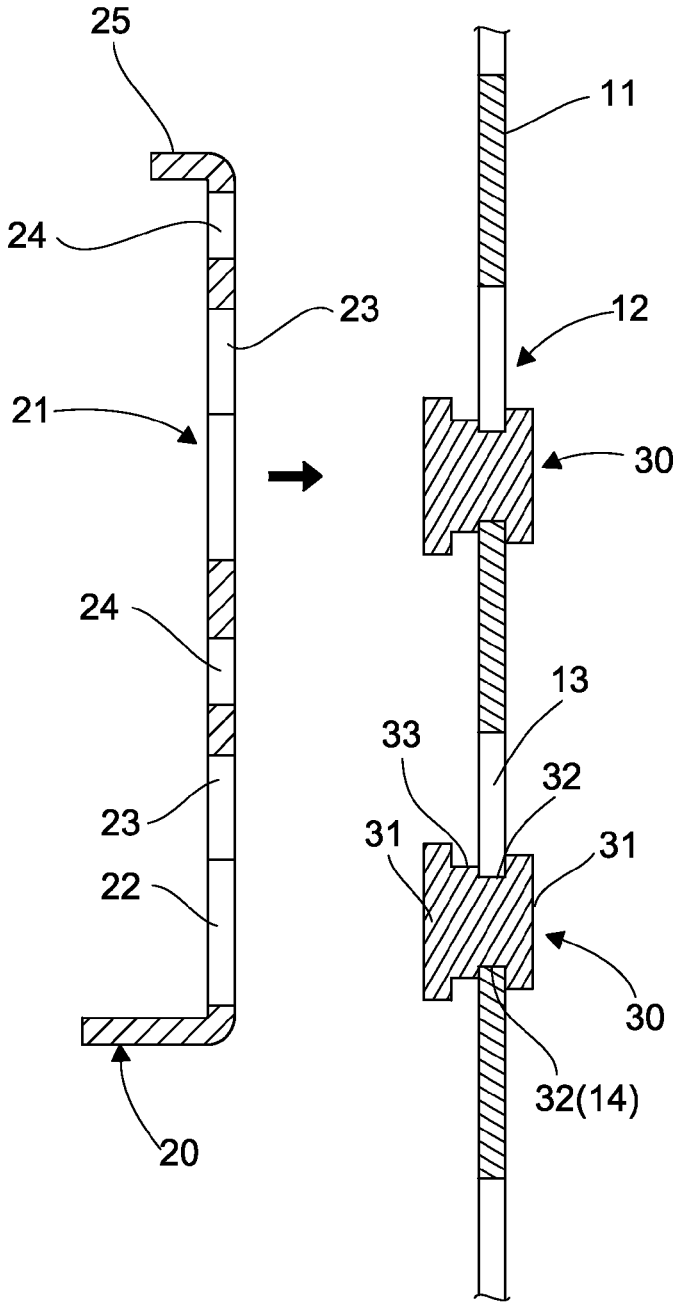
FIGS. 5, 6 and 7 are longitudinal sectional views showing the fastening steps of the interconnecting member and the corner member.
Figure 6:
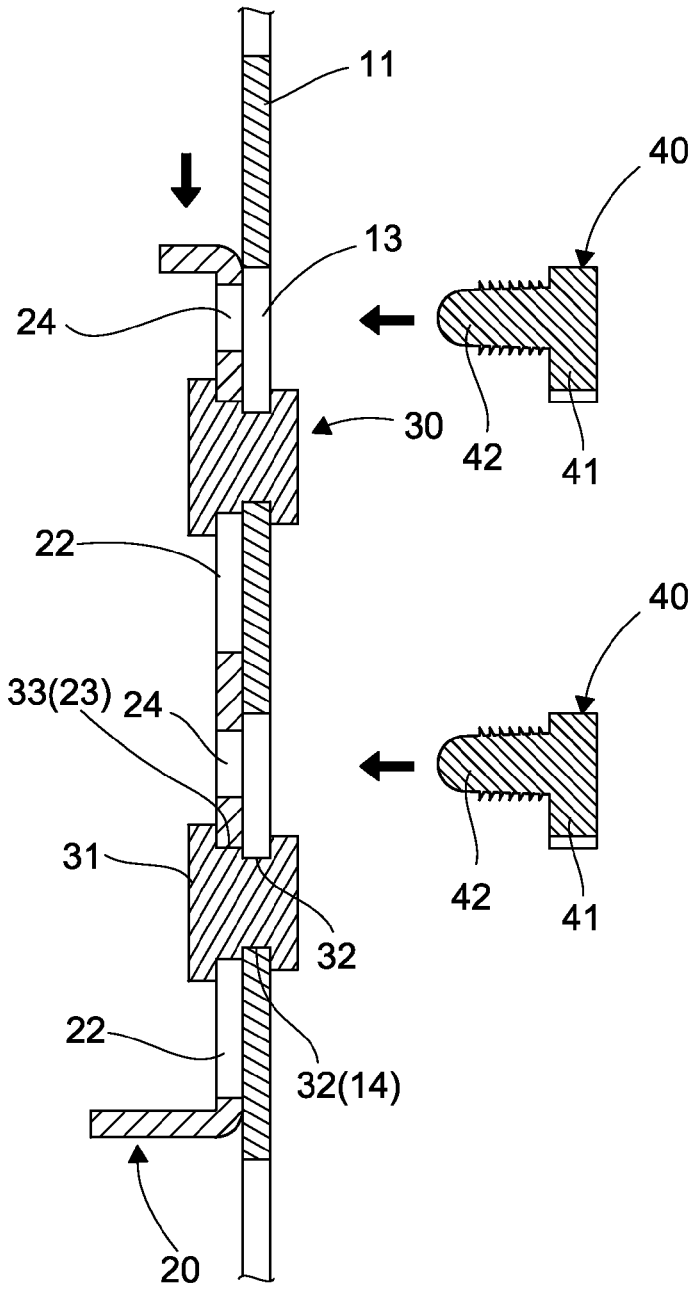
Figure 7:
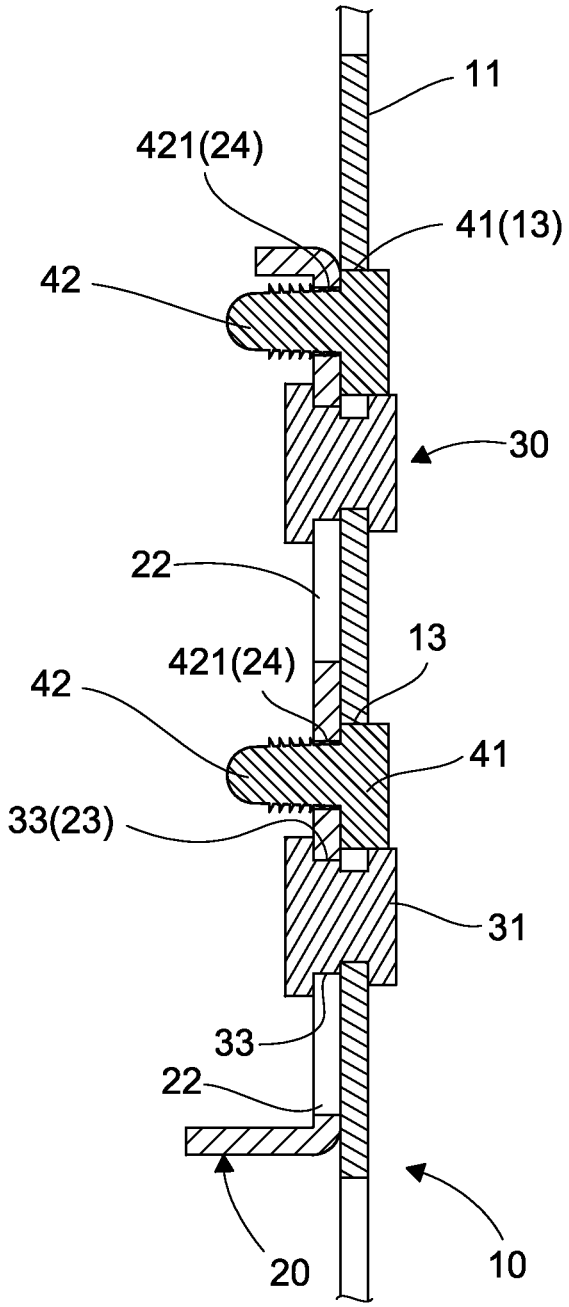
Figure 8:
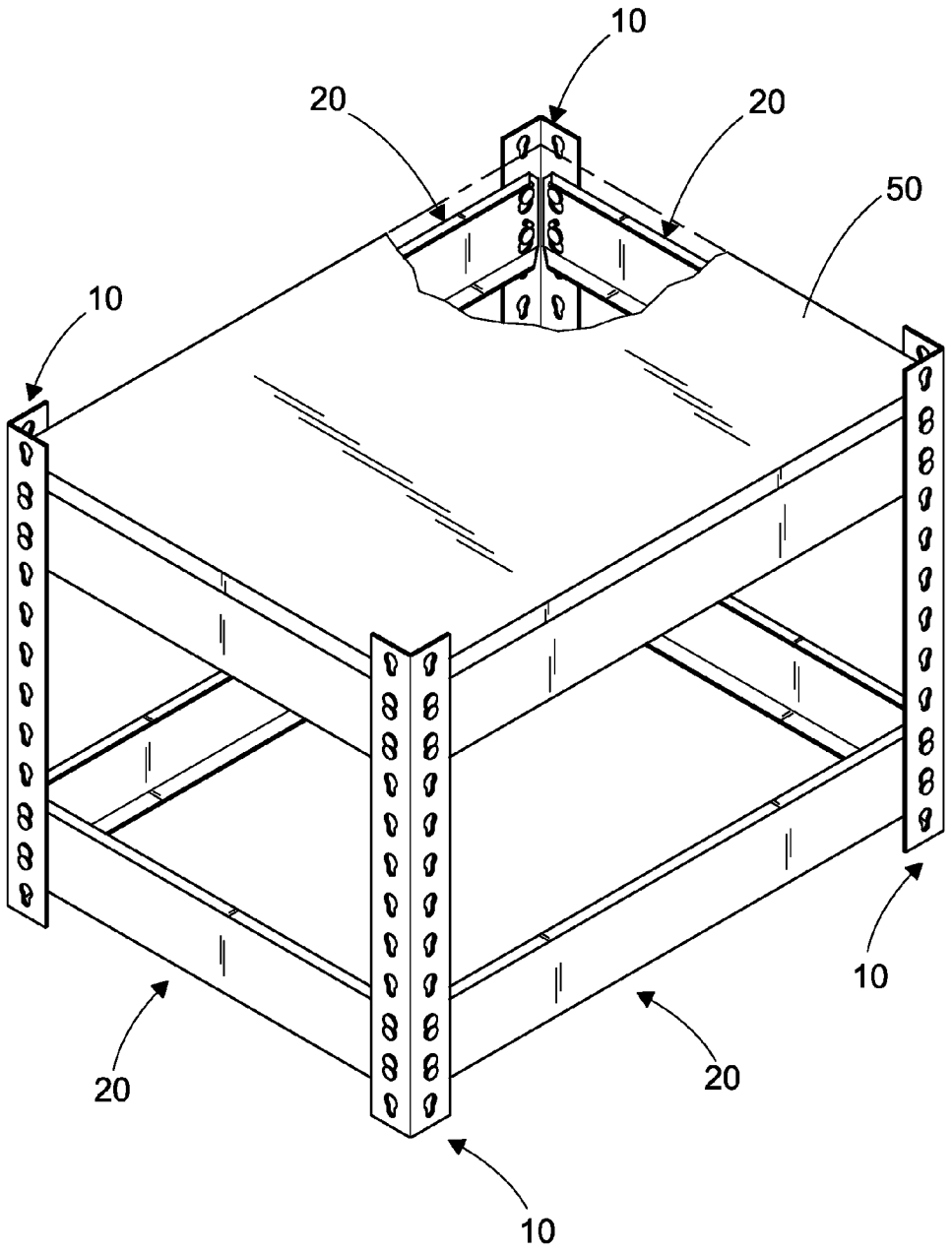
FIG. 8 is a perspective view of the complete adjustable shelving assembly.

In an assembly, the groove 32 of the retainer 30 is rested upon the vertical hole 14 after inserting one enlargement 31 of the retainer 30 through the larger circle 13, aligning the groove 32 with the vertical hole 14 thereunder, and lowering the groove 32 until being stopped (see FIGS. 3 and 5). Next, the interconnecting member 20 is moved to allow one enlargement 31 to pass through the larger circle 22, engage the interconnecting member 20 with the corner member 10, and lower the interconnecting member 20 until the vertical hole 23 is rested upon the shoulder 33 (see FIGS. 5 and 6). Also, the shoulder 33 is clamped by the vertical hole 23, the groove 32 is clamped by the vertical hole 14, and the joined portion of the side wall 11 (i.e., the corner member 10) and the interconnecting member 20 are retained by the retainer 30 (see FIG. 4). Finally, insert the lock pin 40 into the larger circle 13 with the shaft 42 passing through the through hole 24 until being stopped (see FIGS. 6 and 7). A portion of the ridges 421 is threadedly secured to the through hole 24, the head 41 is fastened in the larger circle 13 of the aperture element 12, the cut 411 is partially in the larger circle 13 of the aperture element 12 and urged against the enlargement 31 of the retainer 30 for fastening. Thus, the lock pin 40 is secured and exerts a fastening force on the other enlargement 31 in a friction fit. The interconnecting members 20 and the corner members 10 can be secured together by performing above assembly steps. Finally, a flat shelf 50 is placed on the top bent sides 25 of the interconnecting members 20 in a rectangular area defined by the corner members 10 in a friction fit (see FIG. 8).

It is envisaged that components of the shelving assembly are secured and are adapted to withstand strong force exerted thereon.

It is understood that performing a reversal of the assembly steps can detach the adjustable shelving assembly.

While the invention has been described in terms of preferred embodiments, those skilled in the art will recognize that the invention can be practiced with modifications within the spirit and scope of the appended claims.

What is claimed is:

1. An adjustable shelving assembly comprising:

four corner members of L-shaped cross section, each corner member comprising two halves, and either half of each corner member comprising a plurality of spaced aperture members formed lengthwise, each aperture member including an upper, larger circle and a lower, smaller, vertical hole overlapping the larger circle thereof;

at least one group of four interconnecting members, each interconnecting member comprising 90-degree bent sides, upper and lower aperture elements and a through hole besides each of the upper and lower aperture elements for positioning the interconnecting member, each aperture element comprising an upper, smaller, vertical hole and a lower, larger circle overlapping the vertical hole thereof;

a plurality of elongated retainers each comprising two enlargements at both ends respectively, an annular groove adjacent to one enlargement, and an annular shoulder between the groove and the other enlargement wherein the aperture element is upside down relative to the aperture member such that the aperture element and aperture member are inverted relative to each other, a diameter of either enlargement is smaller than either a diameter of the larger circle of the aperture member or a diameter of the larger circle of the aperture element, and the diameter of either enlargement is larger than either a diameter of the vertical hole of the aperture member or a diameter of the vertical hole of the aperture element;

a plurality of lock pins each comprising a head including a cut, and a shaft extending from the head wherein the shaft of the lock pin has a diameter about equal to a diameter of the through hole and a length greater than a length of the through hole; and at least one flat shelf each disposed on the 90-degree bent sides of the interconnecting members of the same group;

wherein the groove of the retainer is clamped by the vertical hole of the aperture member, the interconnecting member is engaged with the corner member, the shoulder of the retainer is clamped by the vertical hole of the aperture element, the corner member and the interconnecting member are retained by the retainer, a substantial portion of the lock pin is fastened in the larger circle of the aperture member and the through hole, and the cut is partially in the larger circle of the aperture element and urges against the top of the enlargement of the retainer for fastening.

2. The adjustable shelving assembly of claim 1, wherein the shaft of each lock pin further comprises a plurality of curved ridges each threadedly secured to the through hole.

3. The adjustable shelving assembly of claim 1, wherein the head of the lock pin has a diameter about the same as a diameter of the larger circle of the aperture member.

4. The adjustable shelving assembly of claim 1, wherein the larger circle of the aperture member of the corner member has a C-shaped periphery, and the vertical hole of the aperture member of the corner member has a U-shaped periphery.

5. The adjustable shelving assembly of claim 1, wherein the larger circle of the aperture element of the interconnecting member has a C-shaped periphery, and the vertical hole of the aperture element of the interconnecting member has a U-shaped periphery.

* * * * *